United States Patent [19]

Lane

[11] Patent Number: 4,614,867

[45] Date of Patent: Sep. 30, 1986

[54] SHEET SENSING APPARATUS WITH PHOTOELECTRICALLY DETECTED RESILIENTLY MOUNTED NIP ROLLER

[75] Inventor: Martin Lane, Portsmouth, England

[73] Assignee: De La Rue Systems Limited, London, England

[21] Appl. No.: 625,788

[22] Filed: Aug. 6, 1984

Related U.S. Application Data

[63] Continuation-in-part of Ser. No. 625,786, Jun. 28, 1984.

[30] Foreign Application Priority Data

Jul. 1, 1983 [GB] United Kingdom ..... 8317896

[51] Int. Cl.[4] ..... G01N 9/04

[52] U.S. Cl. ..... 250/223 R; 271/263; 271/258

[58] Field of Search ..... 250/231 R, 561, 223 R; 356/381; 271/258, 259, 263

[56] References Cited

U.S. PATENT DOCUMENTS

| | | | |
|---|---|---|---|
| 3,888,478 | 6/1975 | Alderman, Jr. et al. | 271/258 |
| 4,166,615 | 9/1979 | Noguchi et al. | 271/259 |
| 4,398,711 | 8/1983 | Horst et al. | 271/263 |
| 4,484,070 | 11/1984 | Inoue | 271/258 |

*Primary Examiner*—David C. Nelms
*Assistant Examiner*—L. W. Madoo
*Attorney, Agent, or Firm*—Cushman, Darby & Cushman

[57] ABSTRACT

Sheet sensing apparatus comprises a shaft (9); two roller assemblies (20) mounted on the shaft (9) by means including a resilient portion (30), the roller assemblies contacting guide surfaces (27) provided by drive rollers (17). Sensing means (37,38) are provided within the shaft (9) for sensing deflection of the resilient portion (30) relatively to the shaft in response to the passage of one or more sheets (44) through the nips (24) between the roller assemblies (20) and the drive rollers (17). Monitoring means (not shown) connected to the sensing means monitors the sensed deflections of the resilient portion (30).

11 Claims, 4 Drawing Figures

SHEET SENSING APPARATUS WITH PHOTOELECTRICALLY DETECTED RESILIENTLY MOUNTED NIP ROLLER

This application is a continuation-in-part of the copending CROSET and LANE application Ser. No. 625,786, filed June 28, 1984, the content of which is hereby incorporated hereinto by reference.

The invention relates to sheet sensing apparatus particularly, though not exclusively, for use in banknote feeding apparatus such as sorting or counting apparatus where it is necessary to count banknotes passing through the apparatus and to detect the simultaneous passage of two or more notes or notes of an incorrect size.

One example of known sheet sensing apparatus is described in GB-A-No. 1,518,389. In this construction sheets pass between the outer race of a roller bearing and a driven shaft, the roller bearing being mounted on a shaft which is urged towards the driven shaft. In use, when a sheet passes between the roller bearing and the driven shaft, the roller bearing will be urged away from the drive shaft causing movement of the shaft on which the bearing is mounted. This relative movement is detected by sensing changes in capacitance between the two shafts. This apparatus is complex due to the mounting arrangement of the shaft carrying the roller assembly and due to the relatively complex processing circuitry for detecting changes in capacitance. Furthermore, the apparatus may be affected by dust.

GB-A-No.1,160,112 describes apparatus for measuring the flatness of sheet material comprising a plurality of fluid film bearings mounted on a stationary shaft. The sheet material is urged under tension against the outer races of the bearings and changes in pressure in the fluid medium are measured to monitor the flatness of the sheet material. This apparatus is not of use for detecting the passage of individual sheets since these cannot be tensioned against the bearings.

In accordance with the present invention, sheet sensing apparatus comprises a shaft; at least one roller assembly mounted on the shaft by means including a resilient portion; a guide surface, the roller assembly cooperating with the guide surface to define a nip therebetween; sensing means within the shaft for sensing deflection of the resilient portion relatively to the shaft in response to the passage of one or more sheets through the nip between the roller assembly and the guide surface; and monitoring means connected to the sensing means for monitoring the sensed deflections of the resilient portion.

With this apparatus, instead of a complex mounting arrangement for the shaft, deflections of the resilient portion on which the roller assembly is mounted are sensed. This has the added advantage that since the sensing means is provided within the shaft the effect of dust can be avoided. In particular, the sensing means can be sealed within the shaft. This provides a measure of temperature stabilisation and, if the shaft is of metal, has the additional advantage of preventing radio-frequency interference with the sensing elements. Furthermore, the provision of a guide surface and a nip enables sheets to be accurately fed.

The sensing means may have no direct connection with the roller assembly if, for example, the resilient portion carries a magnetic element and the sensing means can sense variations in magnetic field within the shaft (for example a Hall effect sensor).

Preferably, however, the or each roller assembly includes a rigid member protruding into the shaft, the rigid member being radially movable relatively to the shaft in response to deflections of the resilient portion and cooperating with the sensing means.

In this example, the sensing means may include means for generating and receiving electromagnetic radiation, the material of the rigid member being such that on deflection of the resilient portion, the proportion of electromagnetic radiation received by the receiving means varies due to movement of the rigid member. Thus, when a sheet passes between the roller assembly and the guide surface the resilient portion will be compressed and this will result in radial inward movement of the rigid member. This radial movement will cause the rigid member to interfere in a different manner with the passage of electromagnetic radiation between the generating and receiving means, this change being detected.

It is preferable if the monitoring means includes means for detecting whether deflection of the resilient portion is caused by the passage of one or more than one sheet through the nip between the roller assembly and the guide surface. This is useful where it is desirable to detect the passage of, for example two sheets simultaneously.

Preferably, the apparatus comprises two roller assemblies mounted on the shaft and spaced from each other. This is useful where there is the possibility of sheets being folded. The monitoring means can be arranged to generate an error signal if deflection of only one of the resilient portions supporting each roller assembly is sensed.

Conveniently, the or each roller assembly comprises inner and outer races surrounding bearing means, the inner race being coaxial with the shaft and being supported on the shaft by the resilient portion. This is a particularly simple construction and particularly conveniently, the outer race may contact the guide surface. In this case, where the roller assembly includes a rigid member, the rigid member may comprise a pin abutting an inner surface of the inner race and protruding through an aperture in the shaft.

Conveniently, the sensing means is mounted in a housing which is slidable into and out of the shaft. Not only does this enable easy assembly of the apparatus but also enables the sensing means easily to be sealed within the shaft.

Normally, the shaft supporting the or each roller assembly will be fixed against rotation while the guide surface will be provided on one or more cooperating drive rollers mounted on a rotatable drive shaft for transporting sheets through the or each nip.

As has been previously mentioned the apparatus is particularly suitable for use in banknote feeding apparatus such as counting or sorting apparatus.

An example of banknote counting apparatus incorporating sheet sensing apparatus in accordance with the invention will now be described with reference to the accompanying drawings, in which.

Figure 1:
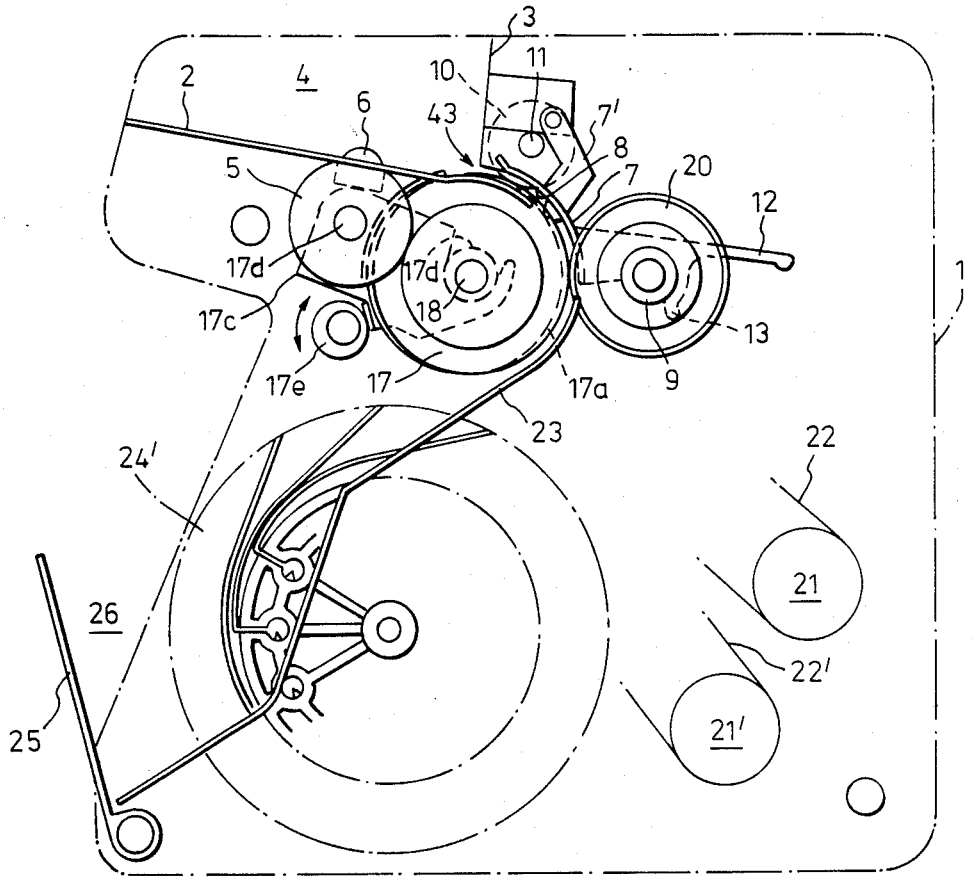
FIG. 1 is a diagrammatic side view of the apparatus.

The apparatus illustrated in the drawings is a banknote counting apparatus.

The apparatus comprises a metal housing 1 supporting a base plate 2 and an end plate 3 of an input hopper 4. Two conventional picker wheels 5 (one shown in FIG. 1) are rotatably mounted to the housing 1 and have radially outwardly projecting bosses 6 which, as the picker wheels rotate, periodically protrude through slots in the base plate 2.

A guide plate 7 having a curved guide surface 8 is pivotally mounted by an arm 7' to a lug 11 attached to the end plate 3. Two separation rollers 10 (only one shown in the drawings) are rotatably mounted to the housing 1. A cantilevered arm 12 is connected to the guide plate 7 and includes a spring clip 13. When the guide plate 7 is in its first position shown, the spring clip 13 is located around a stationary shaft 9. If it is desired to cause the plate 7 to pivot away from its first position, the clip 13 is simply unclipped from the shaft 9 and pivoted in an anti-clockwise direction (as seen in FIG. 1) allowing the operator access to the note feed path so that a note jam can be cleared.

Figure 2:
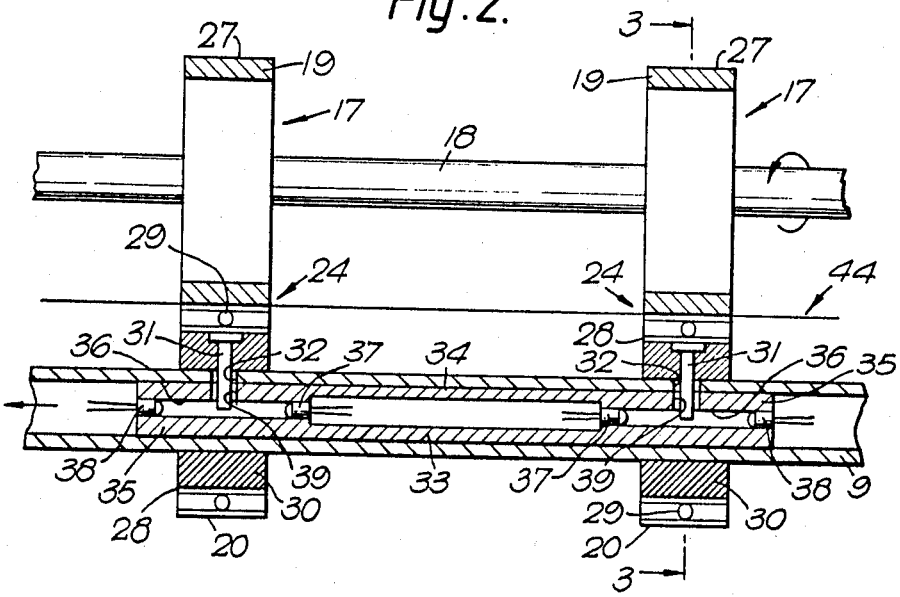
FIG. 2 is a partial cross-section through part of the sheet sensing apparatus with parts omitted for clarity.
Figure 3:
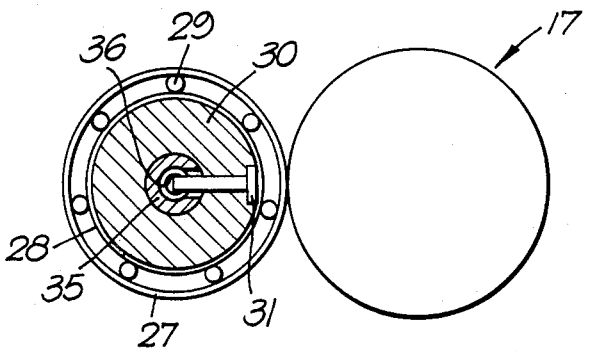
FIG. 3 is a section taken on the line 3—3 in FIG. 2.

A pair of drive rollers 17 are non-rotatably mounted to a drive shaft 18 which is rotatably mounted to the housing 1. Each drive roller 17 has an outer annular portion 19 of rubber. Each drive roller 17 contacts a respective auxiliary roll 20 rotatably mounted on the shaft 9. For clarity, the guide plate 7 has been omitted from FIG. 2.

A stripper roller **17*a* is rotatably mounted on a shaft 17*b* having a larger diameter than the shaft 18 about which it is positioned. The shaft 17*b* is secured between a pair of arms of a cradle 17*c*. The cradle 17*c* is rotatably mounted to an auxiliary drive shaft 17*d* on which the picker wheels 5 are mounted. The cradle 17*c* has a cam portion which engages a cam 17*e* rotatably mounted to the housing 1. Manual rotation of the cam 17*e* forces the stripper roller 17*a* into engagement with the separation rollers 10. The stripper roller 17*a* is driven by the auxiliary shaft 17*d*** via a belt (not shown).

A drive motor 21 (shown schematically in FIG. 1) continuously drives the drive shaft 18 via a drive belt 22. The connection between the drive belt 22 and the drive shaft 18 has been omitted for clarity. The auxiliary drive shaft **17*d* is driven via a drive belt 22' by a drive motor 21'**.

A guide plate 23 extends from adjacent the nips 24 formed between the drive rollers 17 and auxiliary rolls 20 to a conventional stacker wheel 24' rotatably mounted on the housing 1. The guide plate 23 together with an end plate 25 define an output hopper 26 where notes are stacked.

The drive rollers 17 and auxiliary rolls 20 define sheet sensing apparatus for detecting the passage of two or more notes simultaneously and for counting banknotes. Alternatively, separate conventional counting means may be used. The drive rollers and auxiliary rolls are spaced apart by a distance less than the width of sheets being counted.

The shaft 9 is hollow, is non-rotatably supported by the housing 1, and carries the two auxiliary rolls or roller assemblies 20. These are identical in construction and each contacts a respective one of the drive rollers 17.

Each roller assembly 20 comprises a roller bearing having an annular outer race 27, an annular inner race 28 and bearings 29 positioned between the inner and outer races. The bearing is mounted coaxially about the shaft 9 on an annular rubber portion 30. A metal pin 31 abuts the radially inner surface of the inner race 28 and extends through the rubber portion 30 and an aperture 32 in the shaft 9 into the shaft.

A moulded plastics housing 33 is mounted within the shaft 9 and comprises a central tubular portion 34 integral with end portions 36 each of which has a bore 36 communicating with the tubular portion 34. A pair of light emitting diodes 37 are mounted in the inner ends of the bores 36 while a pair of phototransistors 38 are mounted at the outer ends of the bores 36. For clarity, only portions of the connecting wires from the light emitting diodes 37 and the phototransistors 38 have been illustrated. In fact, these wires will pass along and out of the shaft 9 to monitoring circuitry to be described below and to facilitate assembly all wires extend from the same end of the shaft. Each portion 35 of the housing 33 also has an aperture 39 communicating with the bore 36 and in alignment with the aperture 32. The pins 31 extend through the apertures 39 into the bores 36.

Figure 4:
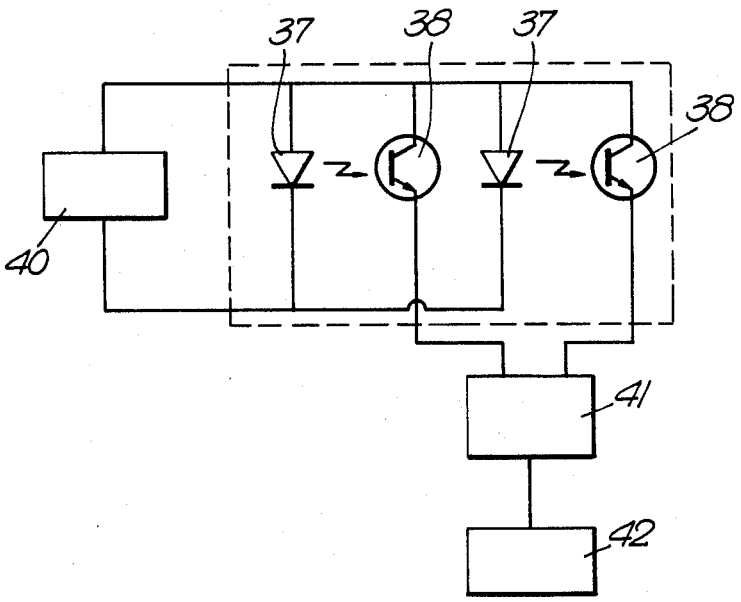
FIG. 4 is a block circuit diagram illustrating circuitry for connection to the sheet sensing apparatus of FIG. 2.

The circuitry is illustrated in more detail in FIG. 4. FIG. 4 illustrates the two light emitting diodes 37 and the phototransistors 38 each of which is connected to a power source 40. The section of the circuit shown enclosed in dashed lines is that section mounted in the plastics housing 33. The output from each phototransistor 38 is fed to monitoring means 41 including a suitably programmed microcomputer. The output from the monitoring means 41 is fed to counting and error display means 42. The monitoring means 41 and the counting and error display means 42 may be of conventional form.

In use, a stack of banknotes is placed in the input hopper 4. The drive motor 21 is actuated so that the drive shaft 18 rotates. The drive motor 21' is actuated to cause the picker wheels 5 to rotate and this causes banknotes at the bottom of the stack to be urged towards a gap 43 between the separation rollers 10 and the stripper roller **17*a*. As the stripper roller 17*a* rotates, it will engage the adjacent note and carry this note past the guide surface 8 and into the nips 24 formed between the auxiliary rolls 20 and the drive rollers 17. The separation rollers 10 and stripper roller 17*a*** are intended to prevent more than one note being fed.

Each LED 37 continuously emits light which impinges on respective phototransistors 38 causing each phototransistor to pass collector current at a predetermined level. Each pin 31 normally partially obscures the light path. When a sheet 44 is presented to the nip 24 between the drive rollers 17 and the respective roller assemblies 20, the sheet will be taken up and transported through the nip and be fed via the guide plate 23 to the stacker wheel 24'. The stacker wheel 24' rotates to stack sheets in the output hopper 26. When the sheet 44 enters each nip, each rubber portion 30 will be compressed radially inwardly due to pressure exerted from the outer race 27 via the bearings 29 and the inner race 28. This movement will also be accompanied by a radially inward movement of each pin 31, which will thus further obscure the path of optical rays from the LED's 37 to the phototransistors 38 thus further attenuating light transmitted to the transistors 38. The degree of cut off of each phototransistor 38 is detected by the monitoring means 41 which, if it detects a similar amount of cut off from each transistor 38 and of an amount equivalent to the passage of one sheet, will increment the counting means 42 by one. If, however, the conductivity of only one of the phototransistors 38 changes then the monitoring means 41 will cause the error means 42 to issue an error message since this will suggest the presence of a folded sheet or half sheet. The monitoring means 41 will also cause the means 42 to display an error indication if the degree of cut off of each transistor 38 is such that more than one note is passing through the nips simultaneously. An even greater reduction in light to the phototransistor may indicate a jam between the rollers and it can be arranged that the machine then stops.

As has been previously explained, the LED's 37 and phototransistors 38 are mounted in a moulded plastics housing 33 and this is slidable into and out of the shaft 9. In order to assemble the apparatus, the housing 33 together with the LED's 37 and phototransistors 38 is pushed into the shaft 9 until the apertures 32 and 39 are in alignment. The rubber portions 30 are then mounted about the shaft 9 and each pin 31 is then slotted through the rubber portions 30 and the apertures 32, 39. Finally, the inner and outer races 28, 27 and bearings 29 are mounted about the rubber portions 30.

If desired, the pin 31 can be mounted in the roller in a position which is diametrically opposite the position shown, in such a manner that the pin moves outwardly and the obscuration of the light is reduced by the passage of a sheet through the nip.

I claim:

1. Sheet sensing apparatus comprising a shaft; at least one roller assembly; roller assembly mounting means including a resilient portion, said at least one roller assembly being mounted on said shaft by said resilient portion; guide means defining a guide surface, said roller assembly cooperating with said guide surface to define a nip therebetween; sensing means within said shaft adapted to sense deflection of said resilient portion relatively to said shaft in response to the passage of one or more sheets through said nip between said roller assembly and said guide surface; and monitoring means connected to said sensing means for monitoring the sensed deflections of said resilient portion.

2. Sheet sensing apparatus according to claim 1, wherein said at least one roller assembly includes a rigid member protruding into said shaft, said rigid member being radially movable relatively to said shaft in response to deflections of said resilient portion and cooperating with said sensing means.

3. Sheet sensing apparatus according to claim 2, wherein said sensing means includes means for generating and receiving electromagnetic radiation, the material of said rigid member being such that on deflection of said resilient portion, the proportion of electromagnetic radiation received by said receiving means varies due to movement of said rigid member.

4. Sheet sensing apparatus according to claim 3, wherein said generating means comprises at least one light emitting diode and said receiving means comprises a phototransistor.

5. Sheet sensing apparatus according to claim 1, wherein said monitoring means includes means adapted to detect whether deflection of said resilient portion is caused by the passage of one or more than one sheet through said nip between said roller assembly and said guide surface.

6. Sheet sensing apparatus according to claim 1, comprising two roller assemblies mounted on said shaft and spaced from each other.

7. Sheet sensing apparatus according to claim 1, wherein said at least one roller assembly comprises bearing means and inner and outer races surrounding said bearing means, said inner race being coaxial with said shaft and being supported on said shaft by said resilient portion.

8. Sheet sensing apparatus according to claim 2, wherein said at least one roller assembly comprises bearing means and inner and outer races surrounding said bearing means, said inner race being coaxial with said shaft and being supported on said shaft by said resilient portion.

9. Sheet sensing apparatus according to claim 8, wherein said rigid member comprises a pin, said inner race defines an inner surface and said shaft defines an aperture, wherein said pin abuts said inner surface of said inner race and protrudes through said aperture in said shaft.

10. Sheet sensing apparatus according to claim 1, further comprising a housing in which said sensing means is mounted, a housing being adapted to be slid into and out of said shaft.

11. Banknote feeding apparatus comprising an input hopper; an output hopper; and means for feeding banknotes from said input hopper to said output hopper, said means including banknote sensing apparatus comprising a shaft, at least one roller assembly, roller assembly mounting means including a resilient portion, said at least one roller assembly being mounted on said shaft by said resilient portion, guide means defining a guide surface, said roller assembly cooperating with said guide surface to define a nip therebetween, sensing means within said shaft adapted to sense deflection of said resilient portion relatively to said shaft in response to the passage of one or more banknotes through said nip between said roller assembly and said guide surface, and monitoring means connected to said sensing means for monitoring the sensed deflections of said resilient portion, said monitoring means being adapted to detect whether deflection of said resilient portion is caused by the passage of one or more than one banknote through said nip between said roller assembly and said guide surface.

* * * * *